US007908770B2

(12) United States Patent
Mallamohamad

(10) Patent No.: US 7,908,770 B2
(45) Date of Patent: Mar. 22, 2011

(54) SHOE ACCESSORY

(76) Inventor: Natalie Mallamohamad, Houston, TX (US)

( * ) Notice: Subject to any disclaimer, the term of this patent is extended or adjusted under 35 U.S.C. 154(b) by 865 days.

(21) Appl. No.: 11/782,467

(22) Filed: Jul. 24, 2007

(65) Prior Publication Data

US 2008/0010866 A1 Jan. 17, 2008

Related U.S. Application Data

(63) Continuation-in-part of application No. 11/208,697, filed on Aug. 22, 2005, now abandoned.

(51) Int. Cl.
*A43B 3/16* (2006.01)

(52) U.S. Cl. ..... 36/70 R; 36/11.5; 36/136

(58) Field of Classification Search ..... 36/70 R, 36/11.5, 136, 72 B
See application file for complete search history.

(56) References Cited

U.S. PATENT DOCUMENTS

| | | | | | |
|---|---|---|---|---|---|
| 1,572,213 | A | * | 2/1926 | Lucas | 36/170 |
| 1,820,679 | A | * | 8/1931 | Sawyer | 36/72 B |
| 1,894,561 | A | * | 1/1933 | Guiffre | 36/11.5 |
| 2,259,273 | A | * | 10/1941 | Smith | 36/11.5 |
| 2,526,940 | A | * | 10/1950 | Fello | 36/11.5 |
| D260,047 | S | * | 8/1981 | Heinz | D2/916 |
| 4,461,100 | A | * | 7/1984 | Minor et al. | 36/72 B |
| D288,382 | S | * | 2/1987 | Birchwood | D2/915 |
| D292,141 | S | * | 10/1987 | Cobb-Holloway | D2/978 |
| D300,780 | S | * | 4/1989 | Walls | D2/915 |
| 4,920,664 | A | * | 5/1990 | McGregor et al. | 36/11.5 |

* cited by examiner

*Primary Examiner* — Ted Kavanaugh
(74) *Attorney, Agent, or Firm* — Patterson & Sheridan, LLP

(57) ABSTRACT

Apparatus and methods secure an open-backed shoe during use. The apparatus prevents the bottom of a pant leg from slipping between a person's heel and a shoe bed of the shoe when walking. The apparatus is external to the shoe and comprises an anklet, which is worn around the ankle and adjustable to the size of an individual's ankle. The anklet is coupled to a heel strap that couples to a heel loop, which attaches to a heel of the shoe.

16 Claims, 4 Drawing Sheets

SHOE ACCESSORY

CROSS-REFERENCE TO RELATED APPLICATIONS

This application is a continuation-in-part of co-pending U.S. patent application Ser. No. 11/208,697, filed Aug. 22, 2005 now abandoned, which is herein incorporated by reference.

BACKGROUND OF THE INVENTION

1. Field of the Invention

Embodiments of the invention generally relate to an accessory for use with an open-backed shoe.

2. Description of the Related Art

When an individual wears long pants with open-backed shoes, fabric at the bottom of the pants has the tendency to move between the individual's heel and a shoe bed. This causes the fabric to become worn, frayed and deformed. In addition, the pant leg can become bunched under the foot creating an unsightly fashion statement.

Furthermore, the open-backed shoes make certain activities difficult and potentially dangerous without a back to retain the shoe in place during use. For example, climbing stairs, dancing or long walks represent some activities in which particular open-backed shoes may be desired to be worn but not well suited. The lack of a heel can also cause a slapping noise, as the shoe hits the individual's heel while walking, which may be undesirable in some instances. Despite such nuisances and problems, many people have and wear the open-backed shoes, thereby requiring owning additional shoes with backs, changing shoes for periods of time depending on activities, or enduring the detriments of the open-backed shoes.

Therefore, a need exists for apparatus and methods that are functional and easily used to secure an open-backed shoe during use.

SUMMARY OF THE INVENTION

In one embodiment, an apparatus for wearing as an accessory to a shoe includes a heel back member having a first end with a first channel and a second end with a second channel. A continuous strap threads through the channels to form a heel loop disposed at the second end of the back member for attachment around an outside of a heel of the shoe. Further, a first end of the continuous strap extends from the first channel and includes a fastener to mate with a second end of the continuous strap such that the ends are positioned to be disposed around an ankle.

A method according to one embodiment of attaching an accessory to a shoe includes connecting a heel loop to a heel of the shoe. The heel loop is part of a continuous strap routed through a heel back member. Sliding the continuous strap relative to the back member tightens the heel loop around the heel and alters a length of free ends of the continuous strap that have a fastener to provide an anklet.

For one embodiment, an apparatus for wearing as an accessory to a shoe includes an anklet formed by two free ends of a strap that wrap around an ankle. A shoe interface formed by a loop of the strap wraps around an outside of a heel of the shoe. The strap is routed along a coupling member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention relate to alleviating problems associated with an open-backed shoe during use. The apparatus prevents or at least inhibits the bottom of a pant leg from slipping between a person's heel and a shoe bed of the shoe when walking. The apparatus is external to the shoe and comprises an anklet, which is worn around the ankle and adjustable in size. The anklet is coupled to a heel strap that couples to an optional heel loop, which attaches to a heel of the shoe, thereby retaining or securing the shoe in place when worn.

Figure 1:
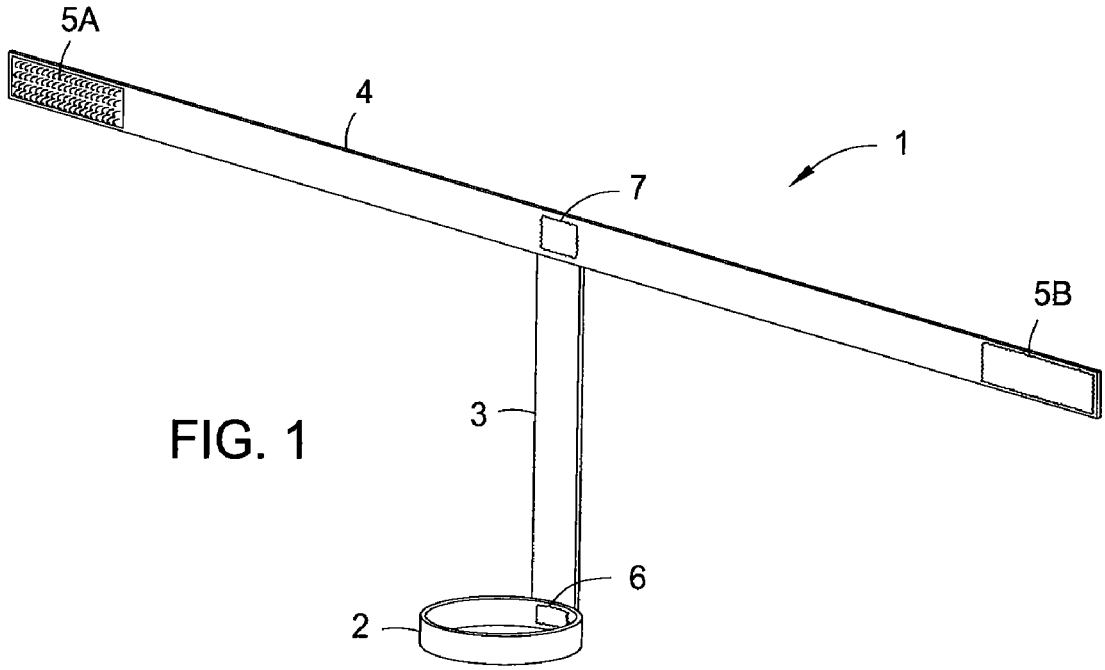
FIG. 1 illustrates an exemplary pant protector in accordance with an embodiment of the invention.
Figure 2:
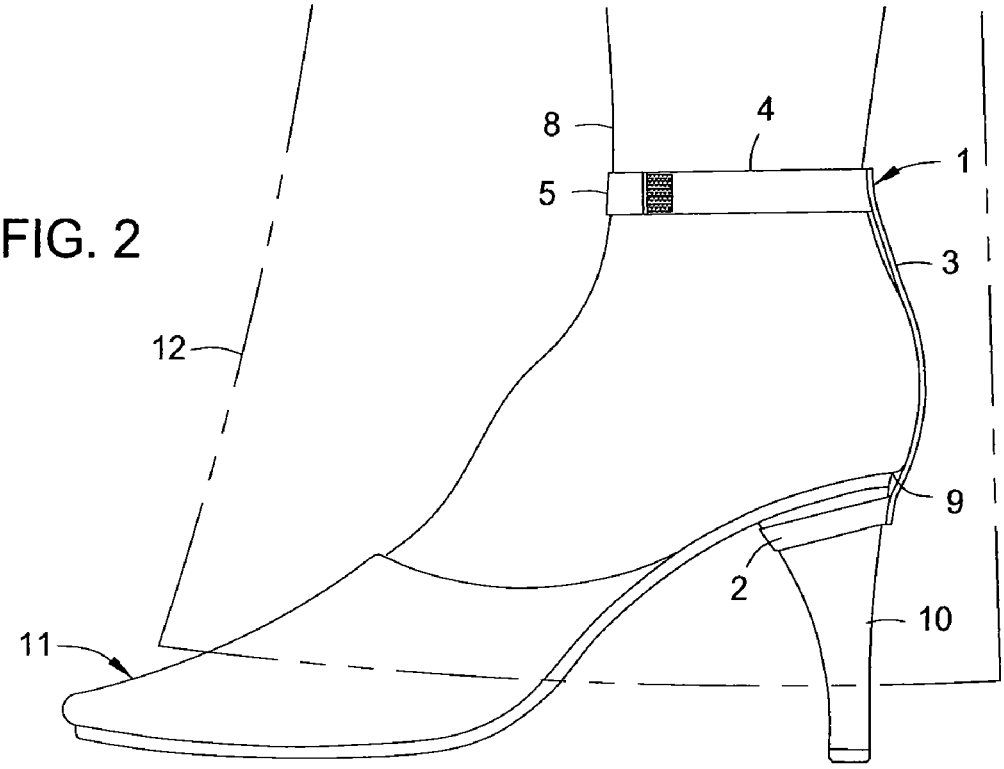
FIG. 2 illustrates the pant protector being worn.

In one embodiment, a pant protector 1 is illustrated in FIG. 1 and shown in use in FIG. 2. The pant protector 1 includes an anklet 4 that wraps around a person's ankle 8 and is fastened with an anklet fastener 5. The anklet 4 can be made from any material, stretch or non-stretch. The anklet fastener 5 can also be any type of fastener such as Velcro®, hook and eye or snap. The anklet fastener 5 can be one part, or it could be composed of two parts, as embodied in 5A and 5B. This invention includes all types of fastening techniques, thus this list of fasteners does not compile an all-inclusive list. In addition, the addition of an anklet fastener 5 can be omitted, such that the anklet material could be tied together without the aid of an anklet fastener 5.

Another feature of the anklet 4 in general, is that it is adjustable, such that it fits ankles 8 of all sizes. The ability to adjust to different sizes of ankles can be done by the anklet 4 itself, or could be accomplished by the anklet fastener 5.

A heel strap 3 connects the anklet 4 at a first end 7 to the heel loop 2 at a second end 6. The preferred embodiment includes sewing the heel strap 3 to the anklet 4 and heel loop 2 at locations 7 and 6, respectively. However, this invention also foresees other fastening techniques. The heel strap 3 is long enough to extend past the bottom of a person's heel and shoe bed 9 of a shoe 11 when in use. It is also within the purview of this invention to have an adjustable heel strap. The heel strap 3 can be made of any type of material, stretch or non-stretch. The heel strap 3 is wide enough such that it does not move away from the back-center of a person's ankle 8, which would allow the bottom of a pant leg 12 to slip under one's foot. The heel strap 3 is also wide enough to form a barrier such that the fabric at the bottom of a pant leg 12 will not slip between the bottom of a person's heel and the shoe bed 9.

A heel loop 2 is connected to the bottom of the heel strap 3 at a second end 6 in the preferred embodiment. The heel loop 2 wraps around a heel 10 of the shoe 11. The heel loop 2 is preferably worn at the point where the heel 10 of the shoe 11 meets the sole of the shoe, but this invention contemplates different placements of the heel loop, such as around the bottom of the heel 10 itself.

The heel loop 2 is preferably a stretch material, such that the heel loop 2 facilitates the heel strap 3 to remain taut against the back of one's heel. The heel loop 2 is also stretchy to allow for varying widths of shoe heels. However, this invention spans the use of heel loop made from material that is non-stretchable.

The heel loop 2 is preferably a loop of material, or a ring of material. However, it is also within the purview of this invention for the heel loop 2 to be a solid cupped piece such that an entire shoe heel 10 is covered with material. The heel loop 2 could also be embodied as an open piece of material with its own fastener. In addition this open piece of material could be fastened by tying the two ends together, in order for a loop to be formed.

The heel strap 3 and heel loop 2 are worn on the outside of the shoe 11. However, in the preferred embodiment, it should not be visible because long pants would extend past the heel loop 2 as shown in FIG. 2.

The preferred method of using the pant protector 1 is to loop the heel loop 2 around the heel 10 of the shoe 11, extend the heel strap 3 up along the back of the ankle 8, wrap the anklet 4 around the ankle 8, and secure with the fastener 5. However, other methods of utilizing the pant protector 1 are within the scope of the invention. In some embodiments, the pant protector 1, despite the name, may be utilized with garments other than long pants such that the garment may not reach the pant protector 1 that thus does not necessarily protect the garment, which is incapable of catching in the shoe due to the length of the garment.

Figure 3:
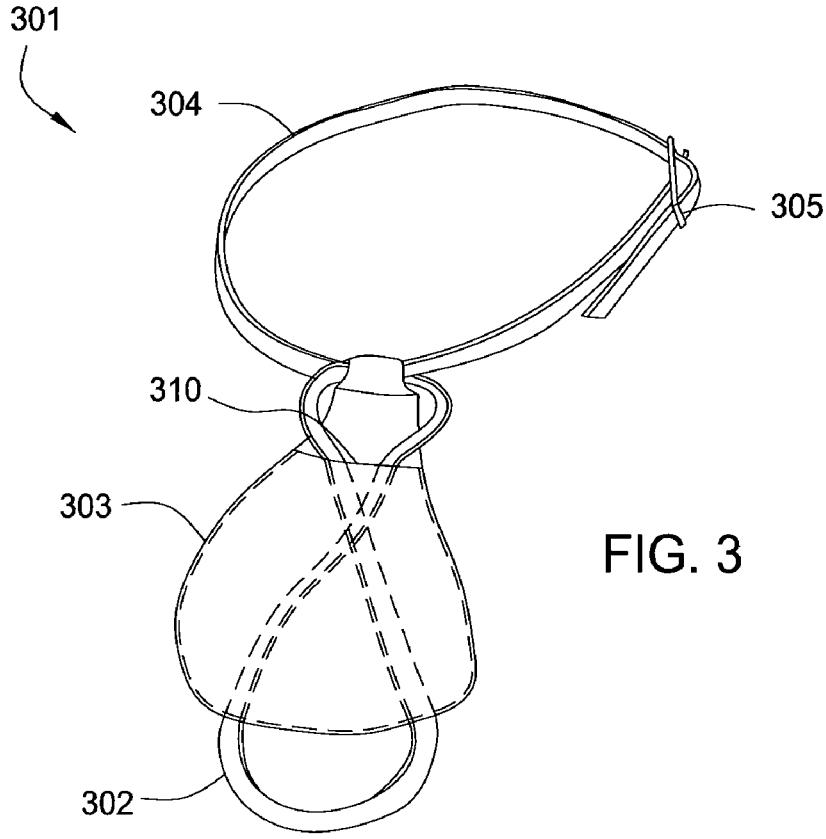
FIG. 3 illustrates an inner side of a shoe accessory in accordance with an embodiment of the invention.
Figure 4:
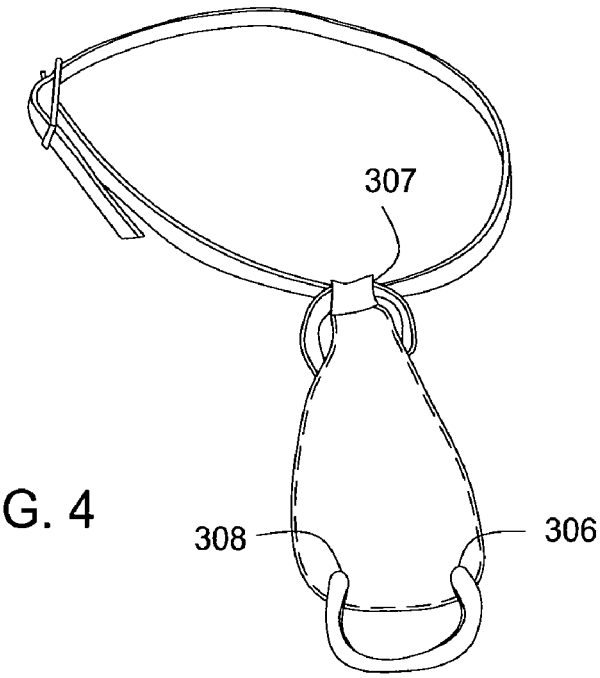
FIG. 4 illustrates an outer side of the shoe accessory shown in FIG. 3.

FIGS. 3 and 4 illustrate an inner side and an outer side, respectively, of a shoe accessory 301 that includes a heel loop 302, a heel strap or back member 303 and an anklet 304, for use as described heretofore. A first end of the anklet 304 includes a buckle 305 for adjustable fastening to a second end of the anklet 304. A single continuous band of material retained by the back member 303 forms both the anklet 304 and the heel loop 302. Due to the arrangement, the continuous band enables adjusting the size of both the heel loop 302 and the anklet 304 utilizing the buckle 305. The buckle 305 may include a conventional tongue member that inserts into one of a plurality of punched eyelets along the length of the second end of the anklet 304.

Starting from the first end of the anklet 304 with the buckle 305, the continuous band passes through a channel 307 within the back member 303. For some embodiments, folding and securing, such as with stitching, a top edge of the back member 303 onto itself may create the channel 307 disposed at a first end of the back member 303. One or two separate apertures through the back member 303 may, in some embodiments, define the channel 307 such as described herein with respect to a second end of the back member 303. Any combination of arrangements depicted for retaining the continuous band by the back member 303 while permitting sliding movement for adjustment may be utilized at either end of the back member 303.

After passing through the channel 307, the continuous band traverses the back member 303 to a second end of the heel strap where the band passes through a first aperture 306 and then returns back through a second aperture 308 (or the first aperture 306 if only one aperture is present). A length of the continuous band between the first and second apertures 306, 308 defines the heel loop 302. From the second aperture 308, the continuous band extends back to the channel 307 and is routed through the channel 307 in a direction such that the second end of the continuous band extends from the channel 307 opposite from the first end with the buckle 305. The band need not cross itself within the back member 303 even though exemplarily shown doing so. To adjust the size of the heel loop 302 for accommodating different shoes, sliding of the continuous band through the first and/or second apertures 306, 308 and the channel 307 repositions the continuous band with any subsequent increase or decrease in length of the anklet 304 being compensated by using the buckle 305.

For some embodiments, the back member 303 includes double layers formed by a backing material 310 sewn onto the back member 303. A central area of the backing material 310 and one perimeter portion of the backing material 310 remains unconnected to the back member 303. The backing material 310 covers the continuous band and permits at the one perimeter portion free ingress and egress of the continuous band disposed along the back member 303.

Figure 5:
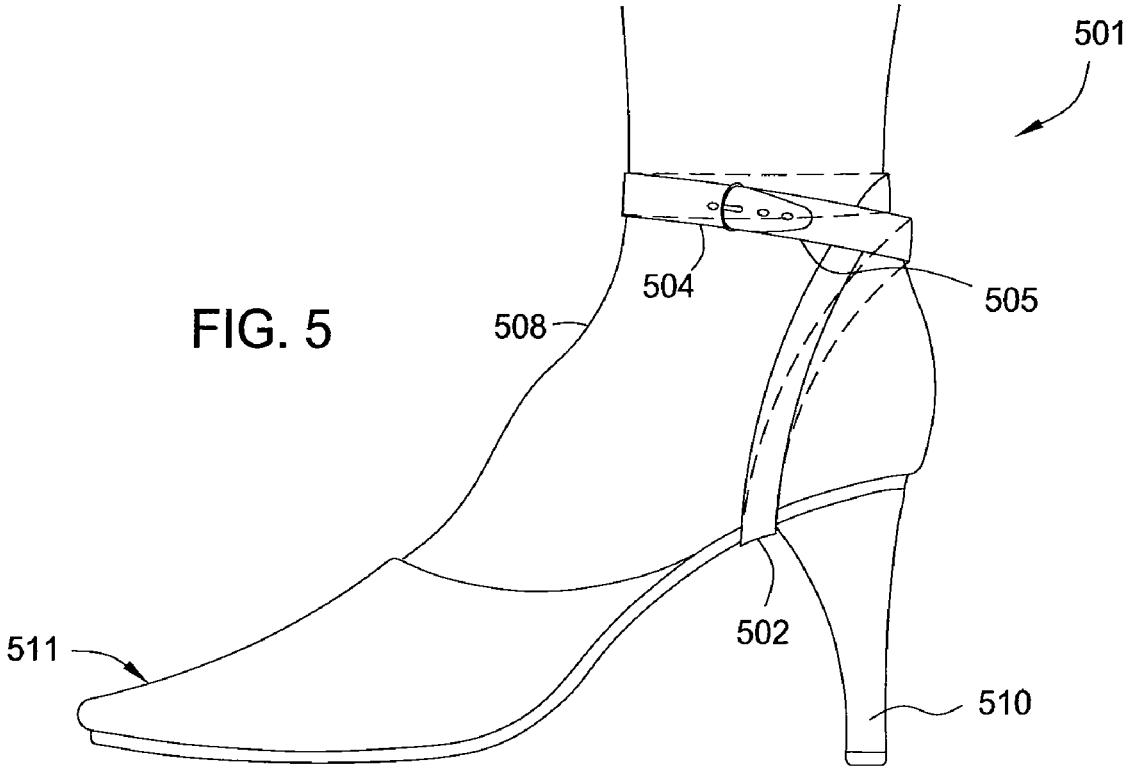
FIG. 5 illustrates a strap type accessory in use according to one embodiment.

FIG. 5 illustrates a strap accessory 501 in use that like the shoe accessory 301 shown in FIGS. 3 and 4 utilizes a single continuous band of material, but does not include the back member 303. The strap accessory 501 includes a first end 504 for fastening to a second end 505 of the strap accessory 501 at a location about an ankle 508 of a user. As with all embodiments, any fastener such as a buckle arrangement shown may be utilized for securing the first and second ends 504, 505 together. The strap accessory 501 may define a straight solid length from the first end 504 to the second end 505 prior to wrapping, as described further herein. In addition, location of the ends 504, 505 depends on the wrapping such that the ends 504, 505 relative orientations may be anywhere along the strap accessory 501 and not necessarily at the ankle 508.

In use, a shoe interface region 502 of the strap accessory 501 traverses an underside of a shoe 511 ahead of a heel 510 of the shoe 511 prior to the strap accessory 501 crossing itself at an overlapping point on a back of the ankle 508. For some embodiments, the strap accessory 501 lacks any connection to itself at the overlapping point and/or any other position between the ends 504, 505 except where the ends 504, 505 themselves are fastened together. A sliding interface (e.g., a slit in the band that one of the ends 504, 505 is passed through) at the overlapping point, in some embodiments, still facilitates the strap accessory 501 accommodating various combinations of shoes and users by permitting size adjustments as necessary. From the overlapping point, the strap accessory 501 extends on both sides of the ankle 508 to a front of the ankle 508 thereby wrapping around the ankle 508.

Upon putting on the shoe 511, attaching the strap accessory 501 includes placing the shoe interface region 502 under the shoe 511 with the length of the shoe accessory 501 transverse to a length of the shoe 511. Next, crossing the strap accessory 501 that is on both sides of the shoe 511 occurs at the overlapping point. Wrapping of the strap accessory 501 continues around the ankle 508 until the ends 504, 505 meet to enable fastening thereof.

Figure 6:
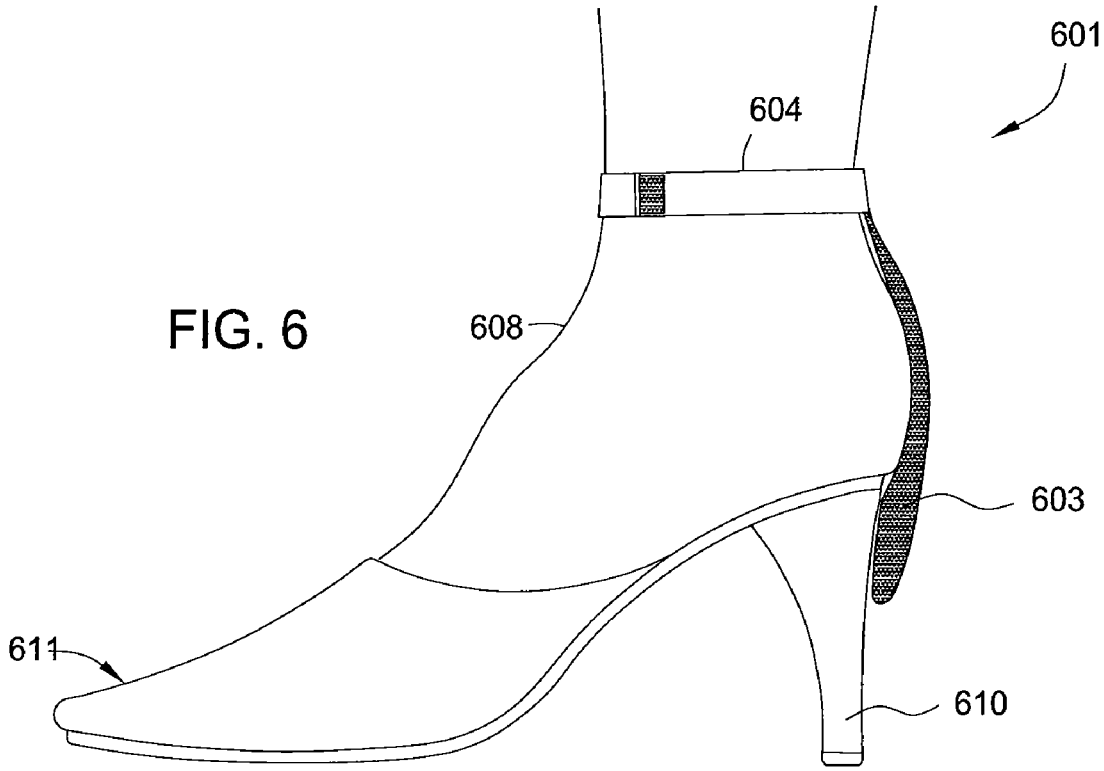
FIG. 6 illustrates a barrier type accessory in use according to one embodiment.

FIG. 6 shows a barrier accessory 601 that attaches to a user without requiring attachment to a shoe 611 worn by the user. The barrier accessory 601 includes an anklet portion 604 secured around an ankle 608 of the user. A barrier member 603 extends from the anklet portion 604 toward a heel 610 of the shoe 611 and down at least a portion of the heel 610 to cover where there is potential for trapping of a pant leg during walking. Sufficient stiffness, size and/or shape of the barrier member 603 may ensure that the barrier member 603 does not become trapped like the pant leg would.

Figure 7:
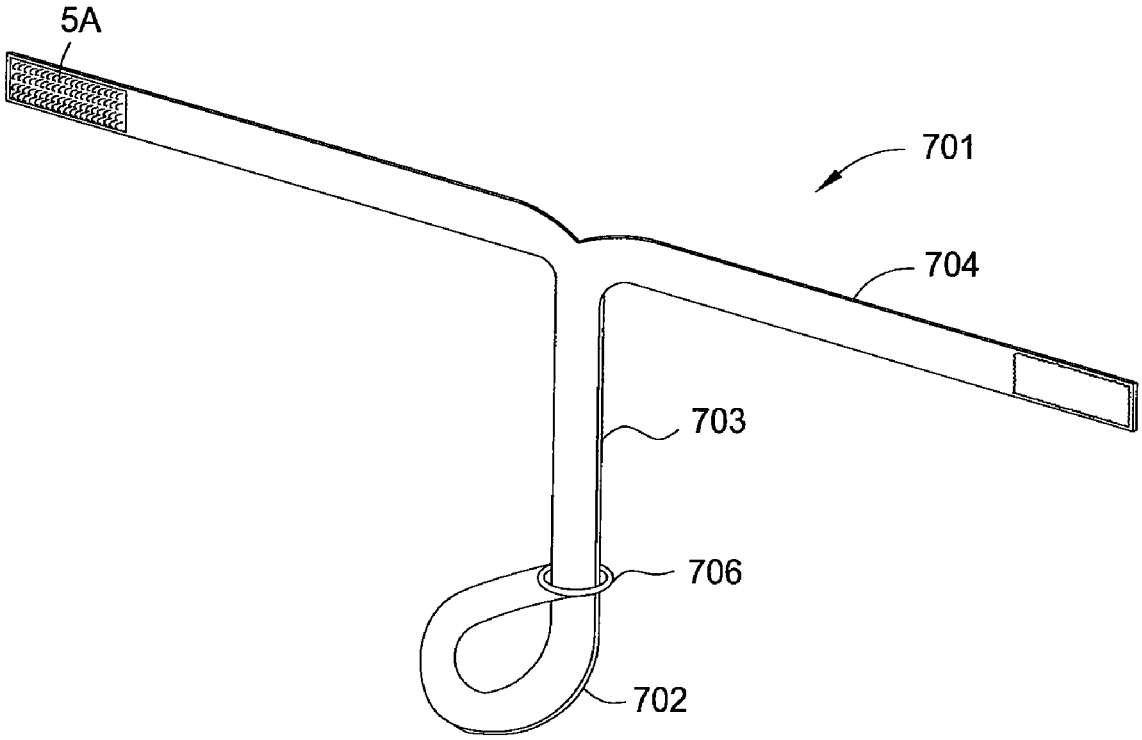
FIG. 7 illustrates yet another pant protecting accessory, according to one embodiment, that functions analogous to the pant protector shown in FIG. 1.

FIG. 7 illustrates a pant protecting accessory 701 that functions analogous to the pant protector 1 shown in FIG. 1 so that details are not repeated for conciseness. The pant protecting accessory 701 includes a strap forming an ankle wrapping portion 704, a heel traversing portion 703, and a heel looping portion 702. A ring 706 or other aperture disposed at one end of the strap creates the heel looping portion 702 by passage of the heel traversing portion 703 and the ankle wrapping portion 704 through the ring 706 to form a loop. As with other embodiments, such an arrangement provides adjustment flexibility combined with simple manufacturability and ease of use.

While the foregoing is directed to embodiments of the present invention, other and further embodiments of the invention may be devised without departing from the basic scope thereof, and the scope thereof is determined by the claims that follow.

What is claimed is:

1. An apparatus for wearing as an accessory to a shoe, comprising:

an anklet formed by two free ends of a strap that wrap around an ankle; and a loop formed by a portion of the strap between the two free ends that wraps around an outside of a heel of the shoe; and a backing member having a channel through which the anklet passes, and at least one aperture through which the portion of the strap passes to form the loop.

2. The apparatus in claim 1, wherein the loop is formed from a stretchable material.

3. The apparatus in claim 1, wherein the anklet includes the two free ends secured together with a fastener.

4. The apparatus in claim 3, wherein the fastener allows for adjustment of the anklet and the loop.

5. The apparatus in claim 1, wherein the portion of the strap traverses the backing member.

6. The apparatus in claim 5, wherein the strap slides through the channel of the backing member to adjust a diameter of the loop.

7. The apparatus in claim 5, wherein the portion of the strap is routed between two layers of the backing member.

8. The apparatus in claim 5, wherein the member includes a channel is formed along a top edge of the backing member.

9. The apparatus in claim 8, wherein the backing member includes a first aperture through a bottom part of the backing member and the portion of the strap passes through the first aperture and returns to a second, aperture beside the first aperture to form the loop.

10. The apparatus in claim 9, wherein the strap is doubled through the channel with a first of the two free ends of the strap extending from a first side of the channel and a second of the two free ends of the strap extending from a second side of the channel.

11. The apparatus in claim 1, wherein the strap is a single continuous strap.

12. An apparatus for wearing as an accessory to a shoe, comprising:

an anklet formed by two free ends of a strap that wrap around an ankle;

a backing member extending from the anklet toward a heel of the shoe and down at least a portion of the heel to interfere with trapping of a pant leg by the shoe during walking, wherein the anklet passes through a channel formed in the backing member; and a loop extending from an aperture formed in the backing member, wherein the loop is formed from a portion of the strap between the two free ends to wrap around an outside of the heel of the shoe.

13. The apparatus in claim 12, wherein the backing member includes a backing material that covers a portion of the strap between the anklet and the loop.

14. The apparatus in claim 12, wherein the backing member covers where there is potential for trapping of the pant leg during walking.

15. The apparatus in claim 12, wherein the channel is disposed at an upper end of the backing member and the aperture is disposed at a lower end of the backing member.

16. The apparatus in claim 1, wherein the channel is disposed at an upper end of the backing member and the at least one aperture is disposed at a lower end of the backing member.

* * * * *

UNITED STATES PATENT AND TRADEMARK OFFICE

CERTIFICATE OF CORRECTION

PATENT NO. : 7,908,770 B2
APPLICATION NO. : 11/782467
DATED : March 22, 2011
INVENTOR(S) : Mallamohamad It is certified that error appears in the above-identified patent and that said Letters Patent is hereby corrected as shown below:

In the Claims:

Column 6, Claim 8, Lines 1-2, please delete "member includes a";

Column 6, Claim 9, Line 6, please delete "," after second.

Signed and Sealed this
Sixteenth Day of August, 2011

David J. Kappos

David J. Kappos
*Director of the United States Patent and Trademark Office*